US005855464A

United States Patent [19]

Bennett

[11] Patent Number: 5,855,464

[45] Date of Patent: Jan. 5, 1999

[54] BINDING APPARATUS

[75] Inventor: John Peter Bennett, Surrey, England

[73] Assignee: James Burn International Limited, Surrey, United Kingdom

[21] Appl. No.: 642,732

[22] Filed: May 3, 1996

[30] Foreign Application Priority Data

May 4, 1995 [GB] United Kingdom ..... 9509046

[51] Int. Cl.[6] ..... B42B 5/10

[52] U.S. Cl. ..... 412/39

[58] Field of Search ..... 412/39, 40, 33, 412/9, 28, 42, 43; 269/46, 55

[56] References Cited

U.S. PATENT DOCUMENTS

| | | |
|---|---|---|
| 4,758,125 | 7/1988 | Wahl . |
| 4,874,279 | 10/1989 | Pfaffle . |
| 5,197,842 | 3/1993 | Bross . |

FOREIGN PATENT DOCUMENTS

| | | |
|---|---|---|
| 0527246 | 8/1991 | European Pat. Off. . |
| 0529881 | 12/1992 | European Pat. Off. . |
| 1329425 | 11/1970 | United Kingdom . |
| 2096540 | 4/1981 | United Kingdom . |
| 2122135 | 4/1983 | United Kingdom . |
| 2267460 | 5/1993 | United Kingdom . |

*Primary Examiner*—Willmon Fridie, Jr.
*Attorney, Agent, or Firm*—Wood, Herron & Evans

[57] ABSTRACT

A binding apparatus for binding pads of perforated sheets with wire binding elements is described. The apparatus has means for supplying a predetermined length of binding element to an insertion station, means for conveying a perforated pad having the binding element inserted through the perforations to a binding station and a binding device at the binding station for closing the binding element to bind the pad. The insertion station includes upper and lower vertically spaced retainer members and a front stop for holding the binding element in a horizontal orientation with the mouth facing upwards. The binding element is supported at the binding station in the same orientation by two horizontally spaced, vertically extending plates with the pad handing down between the plates. Two closing members are provided, one comprising a drive member and a pressure member which is replaceable with other differently sized pressure members to accommodate differently sized binding elements.

31 Claims, 4 Drawing Sheets

BINDING APPARATUS

This invention relates to apparatus for binding pads of perforated sheets to book form such as, for example, notebooks, calenders, instruction manuals and the like with wire binding elements.

The wire binding elements used with such apparatus are formed from a length of wire which is bent to form a series of curved, hair-pin shaped prongs. Each prong has a closed end, or "point", an open end, or "root", and a curved wall therebetween. The curvature of the prongs is such that the element has the appearance of an open sided cylinder with a substantially C-shaped cross-section. Such binding elements will hereinafter be referred to as "binding elements of the type described".

To bind pads of perforated sheets to book form, a binding element of the type described is cut to a predetermined length and a pad of perforated sheets is moved relative to the binding element, or vice versa, so that the points of the binding element pass through the perforations. The binding element is then closed to ring shape by bringing its points into the vicinity of its roots thereby binding the pad.

The step of aligning a pad of perforated sheets with the binding element and moving the pad so that the points of the binding elements pass through the perforations is commonly carried out automatically, see for example British Patent No. 2213769. However, insertion apparatus is relatively complicated and expensive. Furthermore, its complexity and expense is increased if the apparatus is to bind pads of differing sizes with binding elements of varying size.

British Patent Application No. 2267460 discloses a binding apparatus in which a binding element is held in a position such that a pad or sheets can be located with the points of the binding element passing through the perforations of the sheets. The apparatus includes a guide plate against which the edge of the pad adjacent the perforations may be engaged to align the perforations with the points of the binding element and thereby facilitate the insertion step. The binding element is held during insertion with the wall lying generally horizontally by a pair of plates, one supporting the wall and the second at right angles to the first, supporting the sides of the roots of the binding element.

In the apparatus of British Patent Application No. 2267460, after insertion is complete, the binding element and pad are conveyed to a binding station where the pad is lifted to press the points and roots of the element against a backstop, with one side of the element held against a fixed platen. A movable platen is then advanced into contact with the other side of the binding element to close the element to the ring shape.

Other forms of closing device are known. In a number of these the pad to be bound, with the binding element inserted thereinto, is supported in a horizontal position. The binding element is then closed to the ring shape by a pair of closure members acting on the side thereof. In one known binding device, the closure members comprise a fixed lower plate on which the binding element rests in upright orientation and a vertically reciprocal pressure bar. In another known binding device, the closure members comprise two shaped jaws which move together in a rotary path. In the latter case the shaping of the jaws means that they provide sufficient support for the element to prevent distortion thereof during closure. With the reciprocating pressure bar binding device, the element is supported at its wall by a back stop and at its roots or points by an adjustable front stop. The adjustable front stop is pivotally mounted to accommodate movement of the roots or points as the element is brought into the ring shape.

As noted above, problems arise when there is a requirement for binding apparatus to be usable with binding elements of varying size, so far as the insertion system is concerned. The same is true of the closing device as, in general, devices suitable for use with varying size binding elements are relatively complicated, costly and difficult to adjust for different size binding elements. Similar problems arise with devices suitable for binding pads of differing sizes and in particular pads with individual sheets of differing sizes.

In accordance with one aspect of the invention, a closing device for closing a wire binding element of the type described positioned in the perforations of a pad of perforated sheets to bind the pad comprises a first support member with two horizontally spaced, vertically extending guide plates arranged to support the element on the upper edges thereof with the pad hanging downwards between the plates, a first closing member movable relative to a second closing member to close the element and means for mounting the first support member including means for biassing the plates towards a preset pre-closure position, the plates being movable during closing of the element in the direction of the movement of the first closing member thereby to permit movement of the pad.

The provision of a binding element support member in the form of a pair of spaced guide plates has a number of advantages. Firstly, as the pad hangs down therebetween it can be of varying size and can include individual sheets of different sizes. Secondly, the support member provides two point support to the back wall of a binding element which helps prevent distortion on closing. Further, the support member can accommodate a number of different sizes of binding elements provided the edges are sufficiently thick. In addition if, as is preferred, the spacing between the plates is adjustable, the number of differently sized binding elements which can be accommodated can be increased still further.

The capacity of the plates to move against the bias means that the pad can in turn move during closing of the element. This helps prevent distortion of the element on closing.

Suitably the biassing means exerts a greater biassing force on the rear plate considered in the direction of closing movement of the closing members. The rear plate therefore moves further than the front, allowing the pad to take up a position below the binding element as closed to the ring shape. Damping means may be provided for the front plate whereby, after movement of the plates, the front plate returns more slowly to the pre-closure position than the rear plate. The result is the creation of a gap through which the pad and closed element can conveniently fall into a collection unit or on to a conveyor.

Suitably the device includes a back stop defining a maximum travel path from the pre-closure position for the front plate. The back stop may take the form of a cam with a cam surface positioned for abutment by a follower connected to the front plate on movement thereof, the cam being rotatable thereby to alter the portion of the surface abutted by the follower. The capacity to adjust the permitted movement of the front plate and thereby of the pad, allows for fine control of the closure of the element to locate the roots or points in desired final position relative the other. The device may be arranged deliberately to cause the roots to be positioned above or below the points. Alternatively, due to binding element variations, it may be found that this occurs in practice and the device permits adjustment to closure to a true ring shape.

In accordance with another aspect of the invention, a closing device for closing a wire binding element of the type described positioned in the perforations of a pad of perforated sheets to bind the pad comprises first and second support members for the element and first and second closing members, positionable together around the element with the first and second support members in contact respectively with the element wall and the points and/or roots and the first and second closing members therebetween and on either side of the element, wherein one of said support members is adjustable to accommodate differently sized binding elements and wherein one of said closing members is movable relative the other to close the element, the movable closing member comprising a reciprocating drive member and a pressure member secured to and movable with the driving member, the pressure member being replaceable whereby to accommodate binding elements of different sizes.

The arrangement with four members effectively enclosing the binding element produces good closure action without element distortion. The two-part movable closure member with a permanent driving member and a replaceable pressure member allows ready and easy adjustment of the device to accommodate binding elements of different sizes.

Very preferably the driving member has a fixed stroke and a plurality of pressure members are provided each for use with a particular size of binding element and dimensioned such that the overall stroke of the closing member is appropriate for the particular binding element size. Each pressure member may have a generally flat face and be dimensioned such that the pressure member face contacts the element to cause closure thereof at a tangent to the curved side portion thereof.

A very suitable form for the pressure member is with a generally L-shaped cross-section, the toe portion being releasably securable to the driving member. The length of the leg portion may then determine the length of the overall stroke of the closing member. The thickness or width of the leg portion, depending on its orientation, is set to produce the preferred tangential contact between the end of the leg portion and the binding element. For larger binding elements, the leg portion may be provided with a flange extending generally parallel to the toe portion to achieve the tangential contact without making the pressure member too heavy.

The driving member may include a base, a support block secured to the base and a flanged plate secured to the support block, the base, support block and flanged plate together defining an aperture shaped for receipt of the toe portion of each pressure member the toe portion being bolted to the support block. This arrangement enables the pressure member to be easily and rapidly replaced as desired for a particular binding element size.

Very preferably both aspects are combined and in addition the second support member comprises a generally horizontal support plate and a mount therefor which includes adjustment means to allow the vertical distance between the support plate and the first support member to be adjusted thereby to accommodate differently sized binding elements. With this combination, changing the binding element size simply requires adjustment of the vertical position of the horizontal, second support member, plate, replacement of the pressure member and adjustment of the horizontal spacing of the vertical plate of the first support member, all three of which are simple operations which can be rapidly done either manually or automatically.

The binding device may be provided at the binding station of an apparatus for binding pads of perforated sheets with wire binding elements of the type described, the apparatus additionally comprising means for supplying a predetermined length of binding element to an insertion station and means for conveying a pad of perforated sheets having a binding element inserted through the perforations from the insertion station to the binding station.

In accordance with a further aspect of the invention, an insertion station for such a binding apparatus or one with another form of binding device at the binding station, comprises means for holding the binding element in a generally horizontal orientation with the mouth facing upwards and the points exposed, the holding means comprising vertically spaced retainer members and a front stop, the upper retainer member and front stop being positioned respectively above and at the ends of the roots to prevent rotation of the element as the pad is moved to a position in which the points pass through the perforations and the lower member being positioned to support at least a portion of the wall of the binding element.

With such an apparatus, the binding element is held firmly and securely in a readily accessible position for location of a pad with the binding element points inserted through the perforations of the pad. Furthermore, it has been found that the holding means is capable of accommodating differently sized binding elements simply by, as is preferred, making the vertical location of the upper retainer member adjustable.

The lower retainer member may comprise, as in one of the known arrangements described above, a pair of transverse plates. However, preferably it comprises a bar with an element supporting face which lies at an angle to the horizontal, the angle being preferably about 40°–60°, most preferably 45°. It has been found that such a lower retainer member serves firmly to hold all common binding elements irrespective of their size.

The front stop may comprise a vertically oriented plate which extends at least partially within the binding element. The front stop may be secured to a fixed base together with the lower retainer member. In addition, a mount carrying the upper retainer member is provided which is movable relative the base.

The invention will now be further described by way of example with reference to the accompanying drawings in which.

Figure 12A:
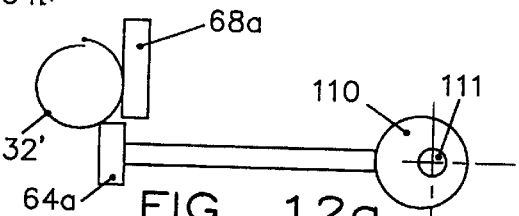
Figure 10:
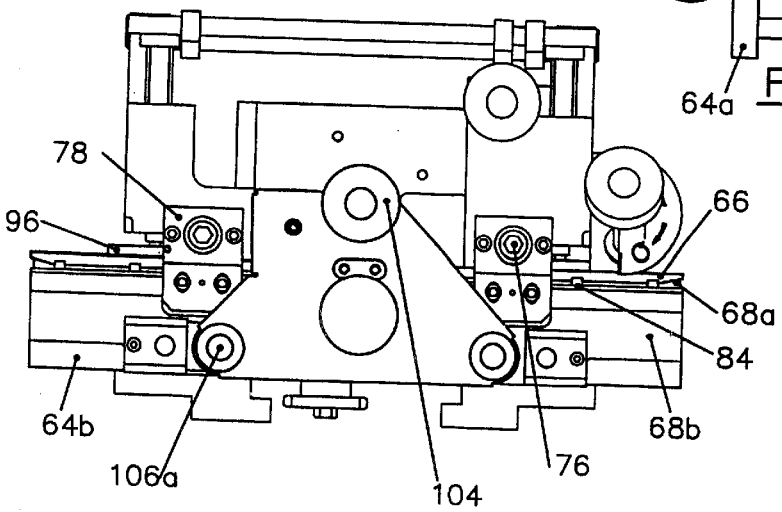
FIG. 10 is a front view of a closing station forming part of the apparatus of FIG. 1.
Figure 14:
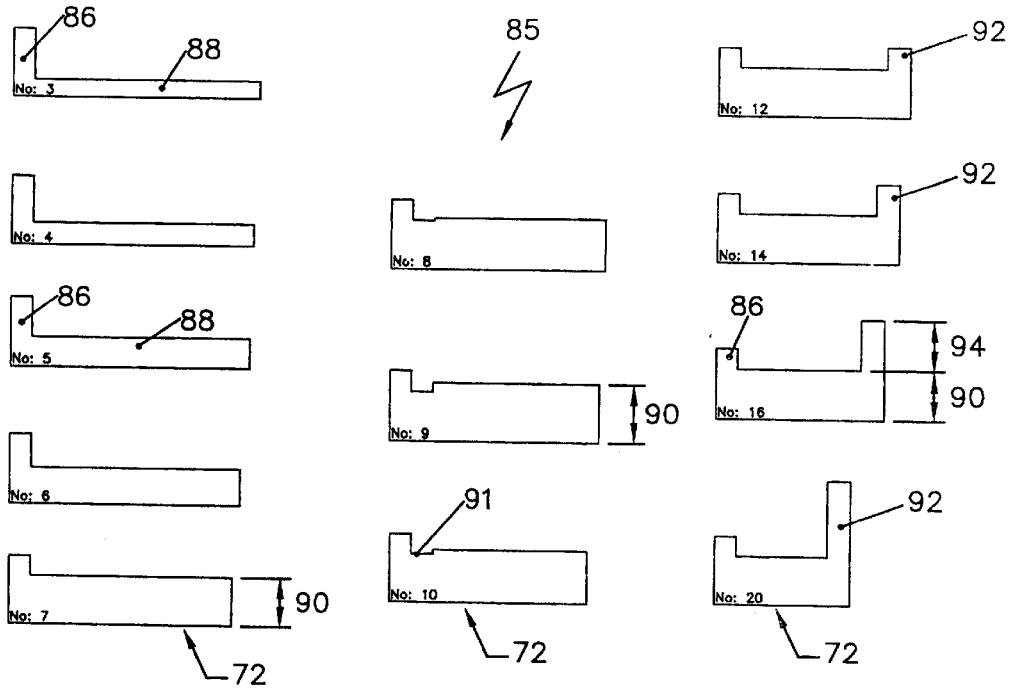
Figure 13:
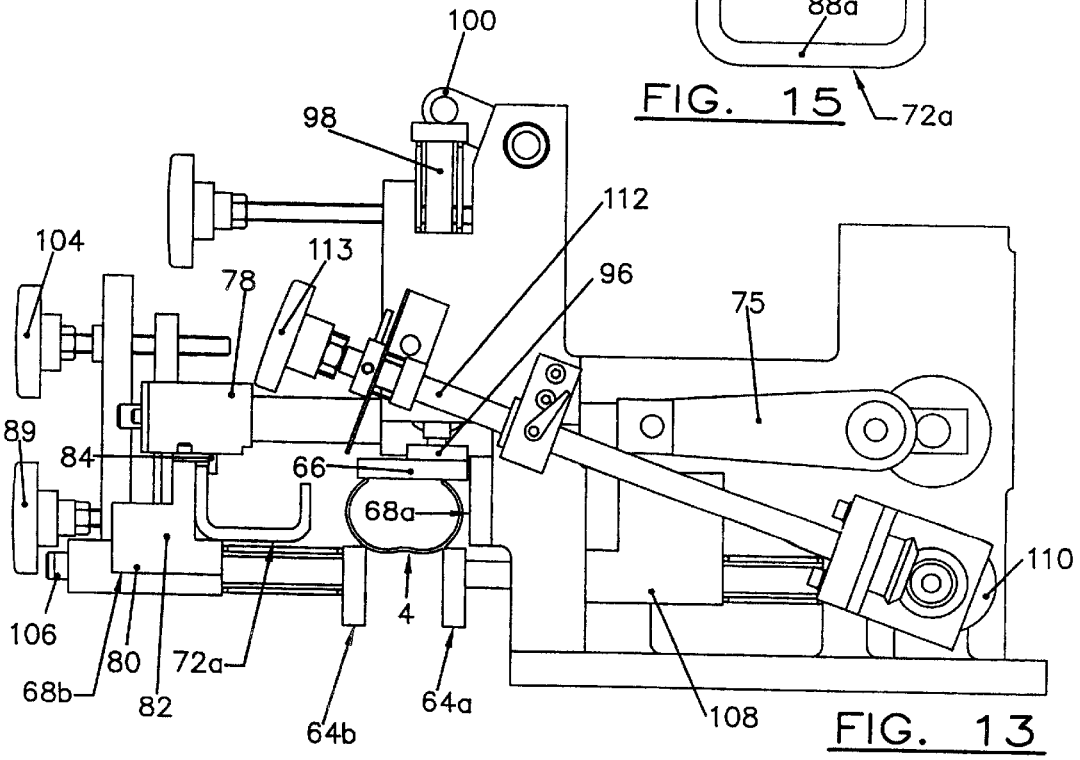

FIGS. 12*a* and *b* are schematic views illustrating an adjustment feature of the closing station of FIG. 10;

FIG. 13 is a side view of part of the closing station of FIG. 10, and,

FIG. 14 is a side view of a plurality of replaceable pressure members usable in the closing station of FIG. 10.

Figure 15:
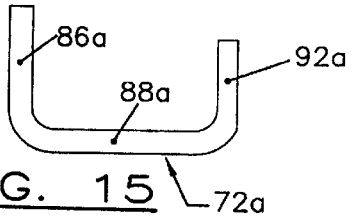

FIG. 15 is a side view of an alternate form of replaceable pressure member.

Figure 1:
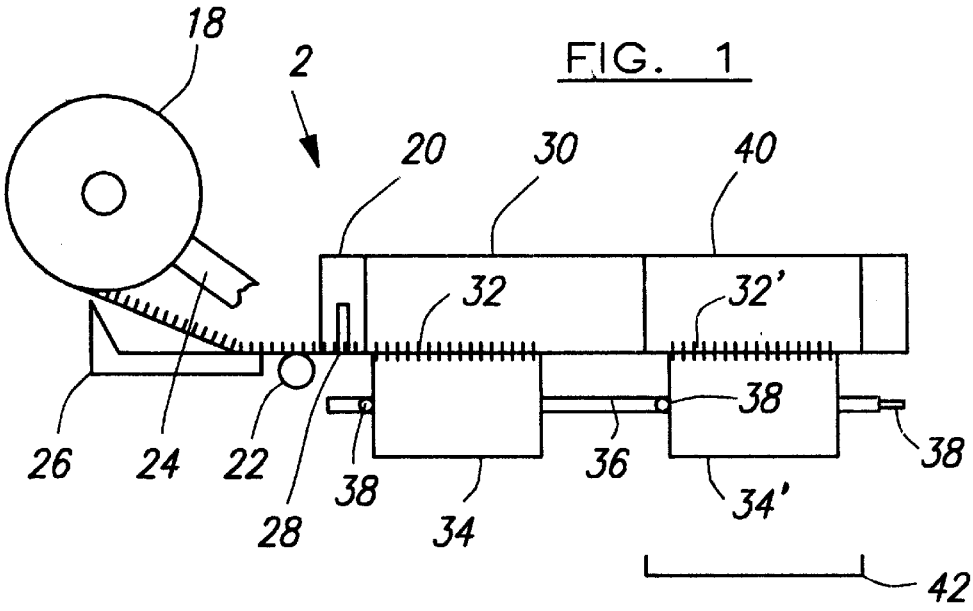
FIG. 1 is a schematic view of an embodiment of an apparatus in accordance with the invention.
Figure 2:
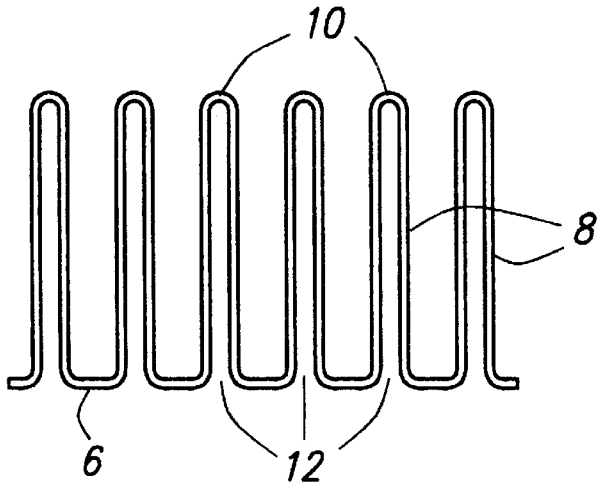
FIG. 2 shows a length of metal wire from which binding elements of the type described are made.
Figure 3:
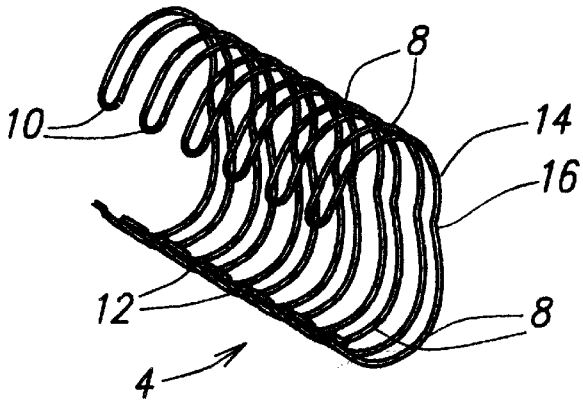
FIG. 3 shows the wire of FIG. 2 shaped into a binding element of the type described.
Figure 4:
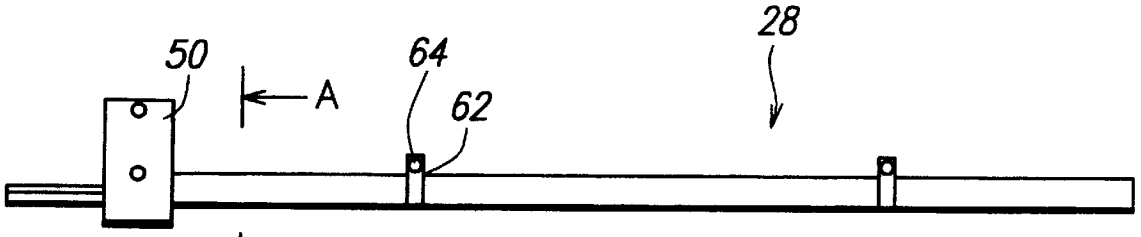
FIG. 4 is a plan view of part of an insertion station forming part of the apparatus of FIG. 1.
Figure 5:
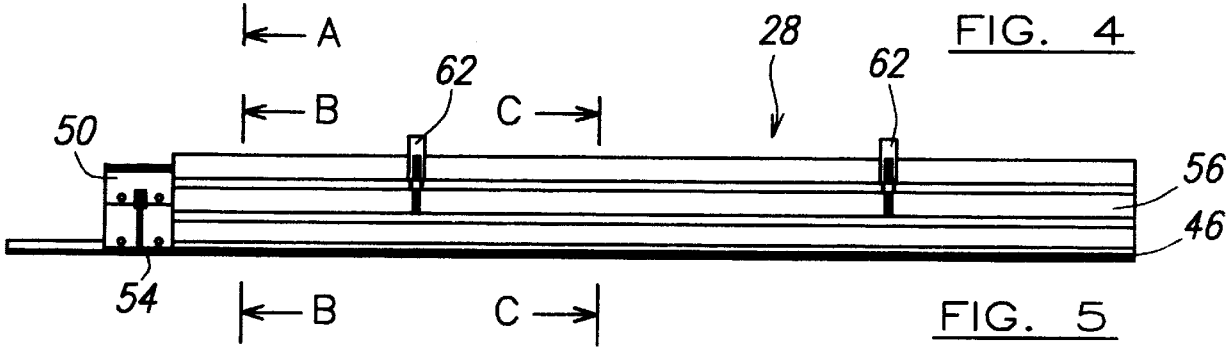
FIG. 5 is a side view of the insertion station of FIG. 4.
Figure 9:
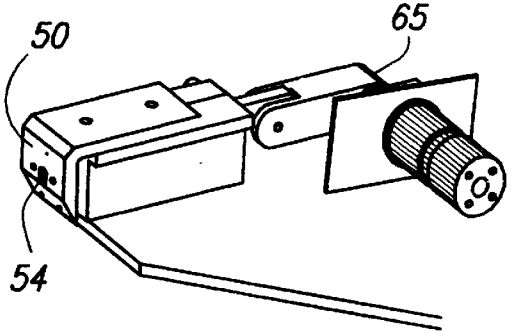
FIG. 9 is a prospective view of a cutting device forming part of the apparatus of FIG. 1.
Figure 8:
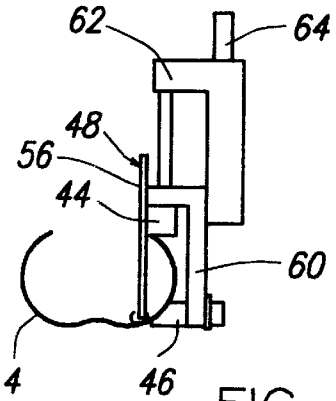
FIGS. 7 and 8 are views taken respectively in the directions B—B and C—C of FIG. 5 with a binding element held in the insertion station.
Figure 6:
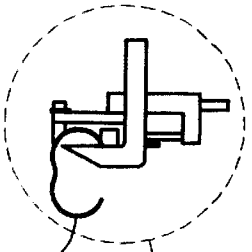
FIG. 6 is a view taken in the direction A—A of FIG. 4 with a binding element held at the insertion station.
Figure 7:
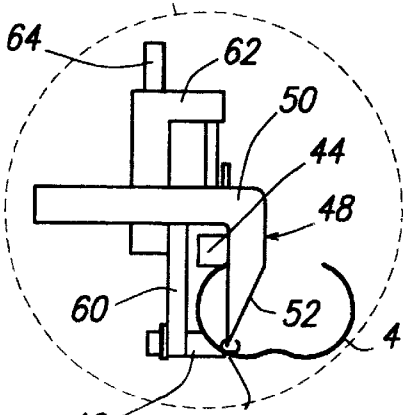
Figure 11:
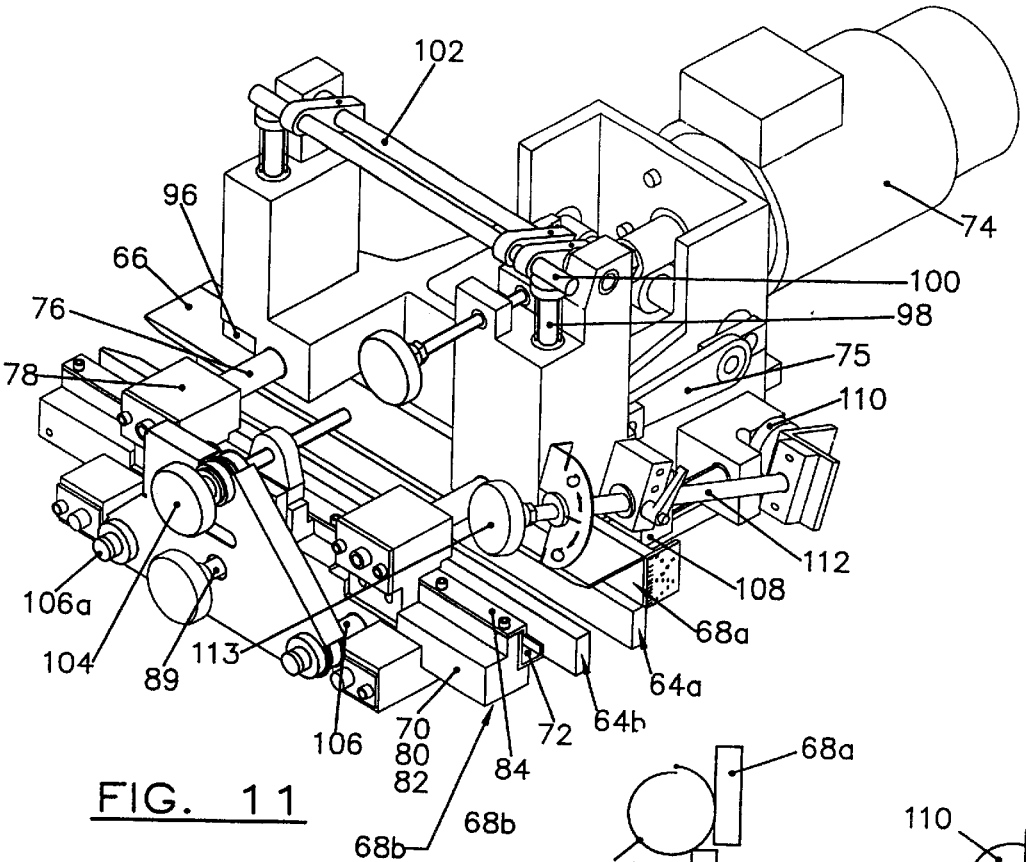
FIG. 11 is a prospective cutaway view of the closing station of FIG. 10.

FIG. 1 shows a binding apparatus 2 for binding pads of perforated sheets to book form with wire binding elements 4. The binding elements 4 are formed from a metal wire which is bent to form a series of curved hair-pin shaped prongs 6 having straight sections 8 therebetween. Each prong 6 has point 10 and a root 12. The sections 8 are then curved such that the binding element 4 has a substantially C-shaped cross section and forms an open-sided cylinder. The cylinder has a wall 14 opposite its open side and a depression 16 in the wall running along the axial length of the binding element 4.

The binding apparatus 2 shown schematically in FIG. 1 comprises a spool 18 of binding element 4 of the type described which is fed to a cutting device 20 from the spool 18 via a magnetised feed and measurement reel 22. The spool 18 is mounted on a lift assembly including pivotal arm 24 which is motor driven to raise or lower the spool 18 for replacement thereof. A wire tray 26 is located below the spool and serves to support and guide the binding element 4 between the spool 18 and the reel 22 which feeds the binding element 4 into a wire guide 28 provided on cutter unit 20 as well as an adjacent insertion station 30.

The binding element 4 is supplied from the spool 18 with its wall 14 generally horizontal and with points 10 at the front, as considered in the sense of FIG. 1. The reel 22 is in the form of a bobbin and has a generally cylindrical core with axially extending indentations circumferentially spaced therearound for receiving and guiding the prongs 12 of the binding element 4. The front flange of the reel 22 is formed from aluminium, whilst the rear flange is formed from steel. This balances the magnetic pull on the points 10 and roots 12 of the binding element 4 as a smaller magnetic force is exerted on the smaller points 10. The reel 22 is driven by a stepper motor which enables a count to be made of the number of prongs 12 of binding element 4 fed by reel 22 to wire guide 28. Once a predetermined number of prongs 12 have been fed corresponding to a predetermined length of binding element 4, the cutter 20 cuts the binding element 4 to produce a cut length 32 at insertion station 30.

A pad 34 of perforated sheets is manually positioned by an operator with the perforations aligned with the points 10 of the length 32 of binding element and the sheets are impaled on the points 10. The pad 34 with length 32 of binding element inserted therein is then moved out of insertion station 30 by an endless pusher belt 36 having a number of pusher members 38 to a binding station 40 to the position indicated at 32', 34'. At the binding station 40 the length 32' of binding element is closed to ring shape thereby binding the pad 34' to book form and the bound pad is collected in a hopper 42 below the binding station 40. Alternatively, in place of the hopper 42 a conveyor could be provided which would remove the bound pad from the area of the apparatus 2. Any other suitable device for use in the finishing of the band pad, such as a cover turning unit, a shrink-wrapping unit, a boxing unit, a packing unit or any combination of these may be provided in place of, or in addition to, a conveyor.

The apparatus 2 is configured so that the operations at the measurement reel 22 and cutting device 20, at the insertion station 30 and at the binding station 40 are carried out simultaneously. The feed of binding element from spool 18 and of pads 34 through the apparatus is interrupted by the operator, by means of a foot pedal, so as to permit the operator time to carried out the insertion operation at the insertion station 30. The apparatus may also be halted to enable the operator to make adjustments so that different sizes of pad and/or binding element can be accommodated in the apparatus 2.

The cutter 20 and wire guide 28 are shown in greater detail in FIGS. 4 to 9. Binding element 4 received from the reel 22 is held in the horizontal orientation by upper and lower retainer members 44, 46 and a front stop 48. At the cutter 20 the front stop 48 is formed by an angled member 50 with a tapered lower front face 52 slotted for passage of a cutting blade 54 therethrough. At the insertion station 30 the front stop 48 comprises a fixed plate 56. The other parts of the wire guide 28 are common for the cutter 20 and the insertion station 30, the upper and lower retainer members 44, 46 comprising bars extending the length of the two stations 20, 30.

The upper and lower retainer members 44, 46 and front stop 48 serve to hold the binding element for assembly in the horizontal orientation in which it is fed from the spool 18 and measurement reel 22 both during cutting of the binding element 4 to form the length 32 thereof and during the insertion operation. The upper retainer member 44 and front stop 48 together hold the roots 12 whilst the lower retainer member 46 supports part of the wall 14 to give both bottom and side support.

The lower retainer member 46 is in the form of a block with a support face 58 which lies at an angle to the horizontal of approximately 40°–60°, preferably 45°. It has been found that this angling renders the lower support member 46 suitable to support binding elements of all common sizes 1", ½", 3⁄16" etc. The lower retainer member 46 is secured to a support 60 to which the front stop 48 is also secured.

The upper retainer member 44 is carried on a pair of spaced brackets 62, the vertical position of which relative the support 60 is adjustable either manually or automatically to allow adjustment of the vertical position of the upper retainer member 44. The adjustment mechanism comprises threaded rods 64 received in correspondingly threaded apertures in the brackets 62. One of the rods 64 is rotated by a motor drive, a tie belt not shown above the support 60 transmitting this motion to the other rod 64. Turning of one of the rods 64 causes raising or lowering of the brackets 62 which are positioned in cut-outs in the support 60 thereby to raise or lower the upper retainer member 44. In the manual version a connector and rotating handle are provided for one of the rods to allow the operator to adjust the position of the upper retainer member 44 to one suitable for the size of binding element for being employed.

Thus, in contrast with known apparatus, only a single part needs to be moved to accommodate differently sized binding elements, it having been found that the combination of this single adjustable part i.e. the upper retainer member 44 with the fixed lower retainer member 46 and fixed front stop 48 serves to hold all common sizes of binding element in the correct alignment and to insure parallel motion. In particular, the binding element length 32 is held with the mouth horizontal during insertion of the points 10 into the perforations of a pad 34, the upper retainer member 44 preventing the roots 12 from rolling up on loading of the pad 34.

The wire guide 28 also holds the binding element 4 firmly during cutting with blade 54. When a desired length has been fed as determined by counting of the steps of the stepper drive of measurement reel 22, the blade 54 is moved in a horizontal path, transversely to the axis of the binding element 4 to sever the element 4 and form the length 32. The blade 54 is driven by a geared motor unit via a spring wrap clutch and a crank 65 which transform the rotary drive to reciprocal movement of the blade 54. The gearing and clutch may be dispensed with by providing a longer stroke crank such that the rearward stroke of the blade 54 is of sufficient length for it to stop in its own time.

Once the operator has moved the pad 34 so that the points 10 of the length 32 of wire binding element have passed through the perforations, the operator releases the pad 34 which is then allowed to fall under its own weight so that it hangs vertically. The length 32 of binding element is prevented from rotating by the wire guide 28 as discussed above. The pad is then moved out of the insertion station 30 by the pusher belt 36 and, at the end of the station 30, pushed by one of the pusher elements 38 into the binding station 40 between a pair of book guide plates 64*a*, 64*b*. The binding element length 32' is supported on the upper edges of the plates 64*a*, 64*b*, as shown most clearly in FIG. 13. The points 10 and roots 12 of the binding element length 32' are supported by an upper element support or top plate 66. Closure members 68*a*, 68*b* are positioned either side of the binding element length 32', the second of which closure members 68*b* is movable towards the first 68*a* to close the binding element length 32'.

The closure member 68*b* comprises a drive member 70 and a pressure member 72. The drive member 70 is connected to a motor 74 by drive links 75 and drive shafts 76. The drive shafts 76 are connected to two brackets 78 which extend upwardly from a base 80 through cut-outs in a support block 82. A flanged plate 84 is secured to the support block 82. The base 80, support block 82 and flanged plate 84 together define an aperture for receipt of part of the pressure member 72. A plurality of replaceable pressure members 72 are provided whereby the closure member 68*b* can accommodate differently sized binding elements.

A set 85 of replaceable pressure members 72 is illustrated in FIG. 14. All the members 72 have in common a generally L-shaped cross-section with a toe portion 86 and leg portion 88. The toe portion 86 is received in the aperture defined by the driving member 70 and secured to the driving member 70 by a screw 89 which passes through the support block 82. The flanged plate 84 guides and supports the pressure members 72 during both attachment to and removal from the drive member 70. That driving member 70 has a fixed stroke so that the length of the leg portion 88 of the pressure member secured thereto determines the overall stroke of the closure member 68*b*. Each pressure member 72 is arranged to have a leg portion length appropriate for the binding element size with which it is to be used. In addition, the thickness 90 of the leg portion 88 of each pressure member 72 is set such that the pressure member 72 will contact the binding element 4 at a tangent to the curved side thereof at the point where the slope is a minimum.

As is illustrated in FIG. 14, the thickness requirement is achieved by providing pressure members 72 in three groups, each of different form. The pressure members 72 of the first group, shown on the left hand of FIG. 14, all have a true L-shaped cross-section. The pressure members of the second group, shown in the middle of FIG. 14, include a notched cut-out 91 in the leg portion 88 adjacent the toe portion 86 to receive the flange of the flanged plate 84. The pressure members 72 of the third group, shown on the right hand of FIG. 14, include a flange 92 at the end of the leg portion opposite the toe portion 86 and extending parallel to the toe portion 86. The thickness 90 of the leg portions 88 of each pressure member in the third group is the same, the tangential abutment being achieved by appropriate setting of the height 94 of the flange 92. The use of flanges 92 in the third group rather than the notches 91 of the second group prevents the pressure members 72 of the third group being too heavy.

FIG. 15 shows an alternative form of pressure member 72*a*. The pressure member 72*a* has a generally U-shaped cross section with one flange 86*a* shaped to be received in the aperture defined in the driving member 70 and the other flange 92*a* being of a height to give tangential abutment with the binding element 4. The length of the web 88*a* sets the overall stroke of the closing member 68*b*. The pressure member 72*a* may be formed by rolling with the outer faces of the flanges 86*a*, 92*a* then being machined flat.

As will be appreciated from FIG. 13, the binding element length 32' when positioned in the closing station 40 is surrounded and enclosed by the lower support member formed by the plates 64*a*, 64*b*, the upper support member 66 and the two closure members 68*a*, 68*b*. If the binding element size is changed, the size of the enclosure is changed by three steps. Firstly, the pressure member 72 is replaced by releasing screw 89, changing the member 72 and then resecuring the screw 89. Secondly, the vertical location of the plate 66 of the upper support member relative the book guide plates 64*a*, 64*b* is adjusted. Any suitable adjustment mechanism, manual or automatic, may be provided. That which is illustrated is similar to the adjustment mechanism for the wire guide upper retainer member discussed above, comprising as it does two brackets 96 each receiving a drive shaft 98 but in this case the drive shafts 98 raise and lower the brackets 96 and thereby the plate 66 by rotation of pivot links 100 each connected to a common driven shaft 102.

The third adjustment step is to change the distance between the book guide plates 64*a*, 64*b*. However, as their name suggests, the distance between the plates 64*a*, 64*b* is basically set by the width of the pad 34' for reasons which will become apparent from the following discussion. So long as the plates 64*a*, 64*b* have sufficiently thick upper edges they can accommodate a multiplicity of differently sized elements. The spacing of the plates 64*a*, 64*b* is therefore set by the operator to one suitable for the pad 34' to be bound. Any suitable manual or automatic adjustment system may be employed. That illustrated comprises a handwheel 104 connected to a shaft 106, which shaft 106 is tied by a belt to a second parallel shaft 106*a*. Rotation of the handwheel 104 by the operator causes guide plate 64*b* to move relative to guide plate 64*a*. The provision of the two tied shafts 106, 106*a* ensures parallel movement of the plate 64*b*.

As discussed above, the binding element 32' is closed to the ring shape by movement of the closure member 68*b* towards the closure member 68*a* which is fixed in position. The pressure member 72 contacts the side of the binding element length 32' at a tangent thereto and moves below the plate 66. The thickness 90 of the leg portion 88 of the pressure members 72 and, as appropriate, the height 94 of the flange 92 are set to allow such movement with the plate 66 in contact with the points 10 and roots 12 of the binding element length 32'. The points 10 and roots 12 are brought together and the binding element length 32' converted to the ring shape. This causes effective movement of the binding element length 32' to the right, as viewed in FIG. 13. The plates 64*a*, 64*b* are mounted such as to accommodate this movement by permitting corresponding movement of the pad 34' positioned therebetween to prevent distortion of the binding element. This is achieved by mounting the plates 64*a*, 64*b* such that they are biased towards the preclosure position illustrated in FIG. 13 but can move against the bias to the right as viewed in that FIG. The biassing force on the front plate 64*a*, considered in the direction of closing movement, is less than that on the rear plate 64*b* so that that rear plate 64*b* in effect drives the front plate 64*a* in the direction of closure movement. A damper block 108 slows the return of the front plate 64*a* to the preclosure position of FIG. 13. As a result, the closed element and pad 34' falls down between the two plates 64*a*, 64*b* either into a collector unit 42 or on to a conveyor, as discussed above.

Figure 12B:
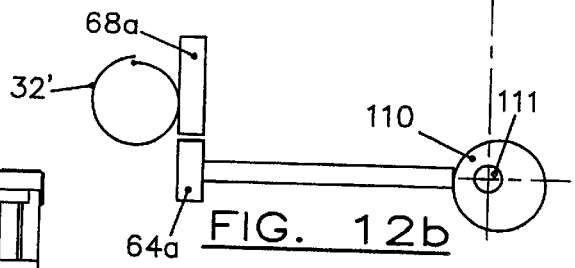

The length of the path moved by the front plate 64*a* affects the closing action, as illustrated schematically in FIGS. 12*a* and 12*b*. FIG. 12*a* shows the situation where the front plate 64*a* at the end of its movement path is offset rearwardly below the closure member 68*a*. This causes the points 10 to be positioned below the roots 12 in the closed binding element length 32'. FIG. 12*b* illustrates the result with alignment between the plate 64*a* and the fixed closure member 68*a* which is that the points then are positioned above the roots 12.

An adjustment system is provided whereby the closing action can be controlled, either deliberately to set the points 10 above or below the roots 12 or, if it is found that this occurs in practice due to binding element variations, to ensure closure to a true ring shape. The adjustment system comprises a cam 110 carried on a rotary drive shaft 111 which is geared to a forwardly extending shaft 112 provided with a handle 113 at its other end. The handle 113 may be rotated by an operator to cause rotation of the shafts 111, 112 and thereby of the cam to set the extent of travel of front plate 64*a*.

Once the binding station 40 has been set up for a particular size of binding element 4 and width of pad 34 it operates automatically. The binding operation therefore can occur simultaneously with feed of further element 4 from the spool 18, cutting thereof and insertion of a pad 34 on a cut length 32. The apparatus is stopped to allow the operator to complete the insertion step and, as and when necessary, for adjustments to be made.

It will be appreciated that as the pad 34 hangs vertically downwards in both the insertion station 30 and the binding station 40 and is only moved transversely in the latter, the apparatus 2 is able to accommodate both differently sized pads and pads with individual sheets of different sizes.

It will also be appreciated that the apparatus 2 can be simply and quickly adjusted to accommodate differently sized binding elements. This is due to the form of the wire guide 28 and the compass point positioning of the four element enclosing members 64*a*, 64*b*, 66, 68*a*, 68*b* at the closing station. The number of fixed members has been maximised and those which move do so along a single axis, as a result of which the adjustment mechanisms therefor can be simple in form and simple to operate.

The wire binding element 4 is held firmly throughout the apparatus 2 and in a readily accessible position from the point of view of insertion. The element is restrained on closure bi-axially and the closing pressure is applied tangentially to the curved side portion. The result is a good closing action. Furthermore variations in the binding element manufacture can be accommodated because of the provision of the adjustment system.

I claim:

1. A closing device for closing a wire binding element positioned in a plurality of perforations of a pad and perforated sheets to bind the pad, the device comprising a first support member with two horizontally spaced, vertically extending guide plates arranged to support the element on the upper edges thereof with the pad hanging downward between the plates, a first closing member movable relative a second closing member to close the element and means for mounting the first support member including means for biasing the plates towards a preset pre-closure position, the plates being movable during closing of the element against the bias to thereby permit movement of the pad.

2. A device as claimed in claim 1, wherein the horizontal spacing of the guide plates is adjustable thereby to accommodate differently sized binding elements.

3. A device as claimed in claim 1, wherein the biassing means exerts a greater bias on the rear plate considered in the direction of closing movement of the closing members.

4. A device as claimed in claim 3, including damping means for the front plate whereby, after displacement of the plates, the front plate returns more slowly to the pre-closure position than the rear plate.

5. A device as claimed in claim 1, including a back stop defining a maximum travel path from the pre-closure position of the front plate, considered in the direction of closing movement of the closure members.

6. A device as claimed in claim 5, wherein the back stop is adjustable whereby to adjust the extent of the front plate maximum travel path.

7. A device as claimed in claim 6, wherein the back stop includes a cam with a cam surface positioned for abutment by a follower connected to the front plate on movement thereof, the cam being rotatable thereby to alter the portion of the surface abutted by the follower.

8. A closing device as claimed in claim 1, further including a second support member positionable in contact with the element roots and points opposite the first support member with the closure members therebetween and on either side of the element, wherein one of said support members is adjustable to accommodate differently sized binding elements and wherein one of said closing members is movable relative the other to close the element, the movable closing member comprising a reciprocating drive member and a pressure member secured to and movable with the driving member, the pressure member being replaceable whereby to accommodate binding elements of different sizes.

9. A device as claimed in claim 8, wherein the driving member has a fixed stroke and wherein a plurality of pressure members are provided, each for use with a particular size of binding element and dimensioned such that the overall stroke of the closing member is appropriate for the particular binding element size.

10. A device as claimed in claim 8, wherein each pressure member has a generally flat face and wherein a plurality of pressure members are provided each for use with a particular size of binding element and dimensioned such that the pressure member face contacts the element to cause closure thereof at a tangent to the curved side portion thereof.

11. A device as claimed in claim 8, wherein a plurality of pressure members are provided, each having a generally L-shaped cross-section, the toe portion being releasably securable to the driving member.

12. A device as claimed in claim 11, wherein at least one of the pressure members include a flange at the opposite end of the leg portion extending generally parallel to the toe portion.

13. A device as claimed in claim 11, wherein the length of the leg portion determines the length of the overall stroke of the closing member.

14. A device as claimed in claim 11, wherein the driving member includes a base, a support block secured to the base and a flanged plate secured to the support block, the base, support block and flanged plate together defining an aperture shaped for receipt of the toe portion of each pressure member.

15. A device as claimed in claim 8, wherein the second support member comprises a generally horizontal support plate and a mount therefor including adjustment means to allow the vertical distance between the support plate and the first support member to be adjusted thereby to accommodate differently sized binding elements.

16. Apparatus for binding pads of perforated sheets with wire binding elements, the apparatus comprising means for supplying a predetermined length of binding element to an insertion station, means for conveying a pad of perforated sheets having a binding element inserted through the perforations from the insertion station to a binding station and a binding device as claimed in claim 1 at the binding station for closing the element thereby to bind the pad.

17. A closing device for closing a wire binding element positioned in a plurality of perforations of a pad of perforated sheets to bind the pad, the device comprising first and second support members for the element and first and second closing members, positionable together around the element, with the first and second support members in contact with the element and the first and second closing members positioned on either side of the element, wherein one of said support members is adjustable to accommodate differently sized binding elements and wherein one of said closing members is movable relative to the other to close the element, the movable closing member comprising a reciprocating drive member and a pressure member secured to and movable with the driving member, the pressure member being replaceable whereby to accommodate binding elements of different sizes.

18. A device as claimed in claim 17, wherein the driving member has a fixed stroke and wherein a plurality of pressure members are provided, each for use with a particular size of binding element and dimensioned such that the overall stroke of the closing member is appropriate for the particular binding element size.

19. A device as claimed in claim 17, wherein each pressure member has a generally flat face and wherein a plurality of pressure members are provided each for use with a particular size of binding element and dimensioned such that the pressure member face contacts the element to cause closure thereof at a tangent to the curved side portion thereof.

20. A device as claimed in claim 17, wherein a plurality of pressure members are provided, each having a generally L-shaped cross-section, the toe portion being releasably securable to the driving member.

21. A device as claimed in claim 20, wherein at least one of the pressure members include a flange at the opposite end of the leg portion extending generally parallel to the toe portion.

22. A device as claimed in claim 20, wherein the length of the leg portion determines the length of the overall stroke of the closing member.

23. A device as claimed in claim 20, wherein the driving member includes a base, a support block secured to the base and a flanged plate secured to the support block, the base, support block and flanged plate together defining an aperture shaped for receipt of the toe portion of each pressure member.

24. A device as claimed in claim 17, wherein the second support member comprises a generally horizontal support plate and a mount therefor including adjustment means to allow the vertical distance between the support plate and the first support member to be adjusted thereby to accommodate differently sized binding elements.

25. Apparatus for binding pads of perforated sheets with wire binding elements, the apparatus comprising means for supplying a predetermined length of binding element to an insertion station, means for conveying a pad of perforated sheets having a binding element inserted through the perforations from the insertion station to a binding station and a binding device as claimed in claim 17 at the binding station for closing the element thereby to bind the pad.

26. Apparatus for binding pads of perforated sheets with wire binding elements comprising means for supplying a predetermined length of binding element to an insertion station, means for conveying a pad of perforated sheets having a binding element inserted through the perforations from the insertion station to a binding station and a binding device at the binding station for closing the binding element thereby binding the pad wherein the insertion station comprises means for holding the binding element in a generally horizontal orientation with the mouth facing upwards and the points exposed, the holding means comprising upper and lower vertically spaced retainer members and a front stop, the upper retainer member and front stop being positioned respectively above and at the ends of the roots and providing transverse generally planar upper and front supporting surfaces for the roots to prevent rotation of the element as the pad is moved to a position in which the points pass through the perforations and the lower retainer member being positioned to support at least a portion of the wall of the binding element.

27. Apparatus as claimed in claim 26, wherein the vertical location of the upper retainer member is adjustable whereby to accommodate differently sized binding elements.

28. Apparatus as claimed in claim 26, wherein the lower retainer member comprises a bar with an element supporting face which lies at an angle to the horizontal.

29. Apparatus as claimed in claim 28 wherein the angle is 40°–60°.

30. Apparatus as claimed in claim 26, wherein the front stop comprises a vertically oriented plate which extends at least partially within the binding element.

31. Apparatus as claimed in claim 26, wherein the holding means comprises a fixed base to which the lower retainer member and the front stop are secured and a mount carrying the upper retainer member and movable relative the base.

* * * * *